US008929049B2

(12) United States Patent
Yagi et al.

(10) Patent No.: US 8,929,049 B2
(45) Date of Patent: Jan. 6, 2015

(54) ION WIND GENERATOR AND ION WIND GENERATING DEVICE

(75) Inventors: Takashige Yagi, Kagoshima (JP); Tetsuya Tojyo, Kagoshima (JP); Hiroshi Makino, San Diego, CA (US)

(73) Assignee: Kyocera Corporation, Kyoto (JP)

( * ) Notice: Subject to any disclaimer, the term of this patent is extended or adjusted under 35 U.S.C. 154(b) by 122 days.

(21) Appl. No.: 13/811,644

(22) PCT Filed: Oct. 27, 2011

(86) PCT No.: PCT/JP2011/074831

§ 371 (c)(1), (2), (4) Date: Jan. 22, 2013

(87) PCT Pub. No.: WO2012/057271

PCT Pub. Date: May 3, 2012

(65) Prior Publication Data

US 2013/0119264 A1 May 16, 2013

(30) Foreign Application Priority Data

Oct. 27, 2010 (JP) ..... 2010-240618

(51) Int. Cl.

| | |
|---|---|
| ***H01T 23/00*** | (2006.01) |
| ***H01J 27/02*** | (2006.01) |
| ***H05H 1/24*** | (2006.01) |
| ***B03C 3/38*** | (2006.01) |
| ***B03C 3/62*** | (2006.01) |
| ***B03C 3/64*** | (2006.01) |

(52) U.S. Cl.

CPC ..... *H01J 27/022* (2013.01); *H01T 23/00* (2013.01); *H05H 1/2406* (2013.01); *B03C 3/38* (2013.01); *B03C 3/62* (2013.01); *B03C 3/64* (2013.01); *H05H 2001/2412* (2013.01); *H05H 2001/2418* (2013.01); *H05H 2001/2437* (2013.01); *B03C 2201/14* (2013.01)

USPC ..... 361/231

(58) Field of Classification Search

CPC ..... H01J 27/22; H01T 23/00; H05H 1/2406; H05H 2001/2412; H05H 2001/2418; H05H 2001/2437; B03C 3/38; B03C 3/62; B03C 3/64; B03C 2201/14

USPC ..... 361/234, 231

See application file for complete search history.

(56) References Cited

U.S. PATENT DOCUMENTS 4,967,119 A * 10/1990 Torok et al. ..... 315/111.91
7,453,682 B2 * 11/2008 Kim et al. ..... 361/231

(Continued)

FOREIGN PATENT DOCUMENTS

EP 2 322 272 A1 5/2011
JP 2007-317656 12/2007

(Continued)

*Primary Examiner* — Scott Bauer
(74) *Attorney, Agent, or Firm* — Volpe and Koenig, P.C.

(57) ABSTRACT

Provided is an ion wind generator capable of diversifying either or both of the amount of wind or wind direction. An ion wind generator is provided with a first electrode, a second electrode having a downstream area which is arranged at a position in a plan view shifted from first electrode towards the positive side in the x direction, and a dielectric between the first electrode and the second electrode. In a plane view, the distance (d) in the x-direction from a downstream side edge of the first electrode to the downstream side edge of the downstream area differs in the y-direction which is perpendicular to the x-direction.

8 Claims, 11 Drawing Sheets

(56) References Cited

U.S. PATENT DOCUMENTS

| | | | | |
|---|---|---|---|---|
| 7,485,265 | B2 * | 2/2009 | Park et al. | 422/186.04 |
| 2006/0159599 | A1 * | 7/2006 | Kiuchi et al. | 422/186.07 |
| 2009/0003859 | A1 * | 1/2009 | Kagawa et al. | 399/50 |
| 2009/0207548 | A1 * | 8/2009 | Seto et al. | 361/231 |
| 2010/0020462 | A1 * | 1/2010 | Sekoguchi et al. | 361/231 |
| 2011/0198312 | A1 * | 8/2011 | Tanaka et al. | 216/13 |

FOREIGN PATENT DOCUMENTS

| | | |
|---|---|---|
| JP | 2009-247966 | 10/2009 |
| WO | WO 2010/007789 A1 | 1/2010 |

* cited by examiner

ION WIND GENERATOR AND ION WIND GENERATING DEVICE

TECHNICAL FIELD

The present invention relates to an ion wind generator and an ion wind generating device.

BACKGROUND ART

Known in the art is a device which induces an ion wind by movement of electrons or ions. For example, Patent Literature 1 applies an AC voltage to two electrodes provided on a substrate-shaped dielectric to generate a dielectric barrier discharge and thereby generate an ion wind on one primary surface of the dielectric.

In Patent Literature 1, two electrodes are formed in rectangular shapes each of which has two sides parallel to the flow direction of the ion wind and two sides perpendicular to the flow direction. Further, Patent Literature 2 discloses art for forming one electrode among the two electrodes into a shape having multi-point terminals on the edge on the other electrode side.

CITATIONS LIST

Patent Literature

Patent Literature 1: Japanese Patent Publication No. 2007-317656 A1

Patent Literature 2: Japanese Patent Publication No. 2009-247966 A1

SUMMARY OF INVENTION

Technical Problem

In the art of Patent Literature 1, the two electrodes are rectangles, therefore the wind direction of the ion wind is the facing direction of the two electrodes. Further, the distribution of amount of wind is uniform in a direction perpendicular to the facing direction of the two electrodes. In other words, the amount of wind and wind direction are unvarying. In the art of Patent Literature 2, multi-point terminals are formed for the purpose of making the wind direction constant. The amount of wind and wind direction are still unvarying.

An object of the present invention is to provide an ion wind generator and an ion wind generating device capable of diversifying at least one of the amount of wind and wind direction.

Solution to Problem

An ion wind generator according to one aspect of the present invention is provided with a first electrode, a second electrode which has a downstream area which is arranged at a position in a plan view shifted from the first electrode in a first direction, and a dielectric which is provided between the first electrode and the second electrode, wherein, in the plan view, a distance in the first direction from a downstream side edge of the first electrode to the downstream side edge of the downstream area differs in a second direction which is perpendicular to the first direction.

An ion wind generating device according to one aspect of the present invention is provided with a first electrode, a second electrode which has a downstream area which is arranged at a position in a plan view shifted from the first electrode in a first direction, a dielectric which is provided between the first electrode and the second electrode, and a power supply which supplies voltage between the first electrode and the second electrode and can make these electrodes induce an ion wind flowing in the first direction, wherein, in the plan view, a distance in the first direction from a downstream side edge of the first electrode to the downstream side edge of the downstream area differs in a second direction which is perpendicular to the first direction.

Advantageous Effects of Invention

According to the above configurations, at least one of the amount of wind and wind direction can be diversified.

BRIEF DESCRIPTION OF DRAWINGS

[FIGS. 1 ]

[FIG. 3 ]

[FIGS. 4 ]

[FIGS. 6 ]

[FIGS. 9 ]

DESCRIPTION OF EMBODIMENTS

Figure 1A:
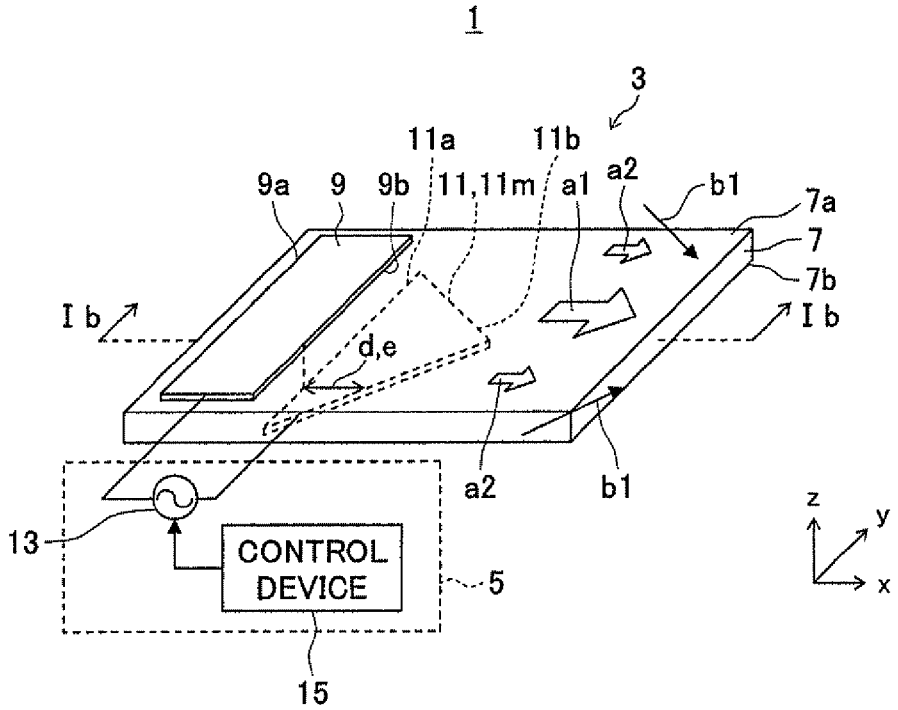
FIG. 1A is a perspective view which schematically shows an ion wind generating device according to a first embodiment of the present invention.

Below, ion wind generators and ion wind generating devices according to several embodiments of the present invention will be explained with reference to the drawings. Note that, the drawings used in the following explanation are schematic ones. Dimensions, ratios, etc. on the drawings do not always coincide with the actual ones. In the drawings, for convenience for explanation, a three-axis rectangular coordinate system (xyz coordinate system) will be suitably defined and referred to.

In the second and following embodiments, with regard to configurations common or similar to those in the already explained embodiments, notations common to those in the already explained embodiments will be used and illustration and explanation will be sometimes omitted. Further, in a case where there are a plurality of the same or similar configurations, sometimes capital letters will be added to the numbers in the notations or omitted.

<First Embodiment>

Figure 1B:
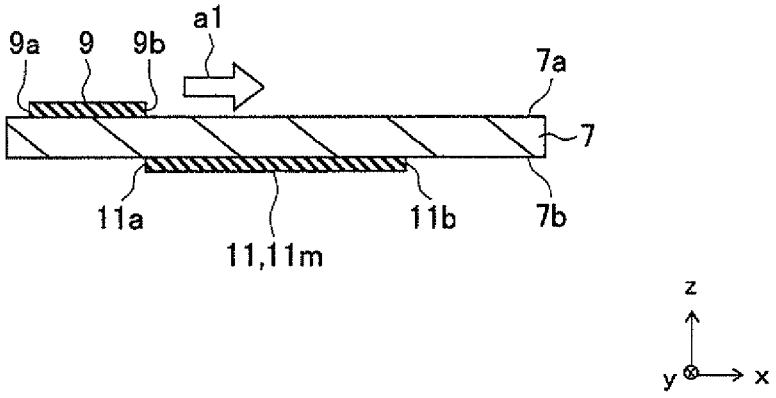
FIG. 1B is a cross-sectional view along an Ib-Ib line in FIG. 1A.

FIG. 1A is a perspective view which schematically shows an ion wind generating device 1 according to a first embodiment of the present invention, and FIG. 1B is a cross-sectional view along an Ib-Ib line in FIG. 1A.

The ion wind generating device 1 is configured as a device for generating an ion wind which roughly flows in a direction indicated by arrows a1 and a2 (x-direction).

The ion wind generating device 1 has an ion wind generator 3 for generating an ion wind and a drive part 5 (FIG. 1A) for driving and controlling the ion wind generator 3.

The ion wind generator 3 has a dielectric 7 and a first electrode 9 and second electrode 11 isolated by the dielectric 7. The ion wind generator 3, by application of voltage between the first electrode 9 and the second electrode 11, generates a dielectric barrier discharge and generates an ion wind.

The dielectric 7 is for example formed in a flat sheet shape (substrate shape) having a constant thickness and has a first primary surface 7*a* and a second primary surface 7*b* at the back thereof. The ion wind flows as indicated by arrows a1 and a2 on the first primary surface 7*a* along the first primary surface 7*a*. Note that, on the second primary surface 7*b* as well, an ion wind directed roughly inverse to the ion wind on the first primary surface 7*a* is generated, but the explanation is omitted in the present embodiment. The planar shape of the dielectric 7 may be a suitable shape, but FIG. 1 exemplifies a case where it is formed as rectangle having sides parallel in the x-direction and sides parallel the y-direction.

The dielectric 7 may be formed by an inorganic insulating material or may be formed by an organic insulating material. As inorganic insulating materials, for example, there can be mentioned ceramic and glass. As the ceramic, for example, there can be mentioned an aluminum oxide sintered body (alumina ceramic), glass-ceramic sintered body (glass-ceramics), mullite sintered body, aluminum nitride sintered body, cordierite sintered body, and silicon carbide sintered body. As the organic insulating material, for example, there can be mentioned a polyimide, epoxy, and rubber.

The first electrode 9 and second electrode 11 are for example formed in layer shapes (including flat sheet shapes) having constant thicknesses. The first electrode 9 is laid on the first primary surface 7*a*, and the second electrode 11 is laid on the second primary surface 7*b*. In other words, the dielectric 7 is provided between the first electrode 9 and the second electrode 11 and isolates these electrodes.

The first electrode 9 and second electrode 11 are arranged offset from each other in the x-direction (flow direction of the ion wind). In other words, the second electrode 11 has a downstream area 11*m* located nearer one side (positive side) of the x-direction than a downstream side edge 9*b* of the first electrode 9. By provision of such downstream area 11*m*, on the first primary surface 7*a*, an ion wind from the downstream side edge 9*b* side to the downstream area 11*m* side is generated.

Note that, in the plan view of the first primary surface 7*a* or second primary surface 7*b*, in the x-direction, the first electrode 9 and second electrode 11 may partially overlap, may be adjacent without a gap, or may be spaced apart with a predetermined gap. FIG. 1 exemplifies a case where the first electrode 9 and second electrode 11 are adjacent without a gap. Note that, in this case, the downstream area 11*m* is the second electrode 11 as a whole.

The first electrode 9 extends in the y-direction. More specifically, for example, the planar shape of the first electrode 9 is a rectangle having sides parallel in the x-direction and sides parallel in the y-direction. Accordingly, the downstream side edge 9*b* of the first electrode 9 forms a linear shape extending in a direction perpendicular to the direction in which the ion wind is to be generated.

The planar shape of the second electrode 11 is for example an isosceles triangle with an upstream side edge 11*a* as the base. The upstream side edge 11*a* is parallel to the downstream side edge 9*b* of the first electrode 9. Accordingly, in a plan view, the downstream side edge lib of the second electrode 11 (downstream area 11*m*) is not parallel to the downstream side edge 9*b* of the first electrode 9, and the distance "d" from the downstream side edge 9*b* to the downstream side edge 11*b* differs in the y-direction.

Note that, in a plan view, the distance "d" is the shortest distance from each position at the downstream side edge 11*b* of the second electrode 11 to the downstream side edge 9*b* of the first electrode 9. That is, this is the distance on the perpendicular line (shortest route) drawn from each position at the downstream side edge 11*b* to the downstream side edge 9*b* of the first electrode 9 (the distance in the direction (x-direction) perpendicular to the downstream side edge 9*b*).

Further, in a plan view, the second electrode 11 (downstream area 11*m*) changes in length "e" from the upstream side edge 11*a* to the downstream side edge 11*b* in the x-direction. More specifically, the length "e" becomes large at the center side in the y-direction.

Note that, in the present embodiment, in a plan view, the position of the downstream side edge 9*b* of the first electrode 9 and the position of the upstream side edge 11*a* of the second electrode 11 coincide, so the length "e" is equal to the distance "d".

The first electrode 9 and second electrode 11 are formed by a conductive material such as a metal or the like. As the metal, there can be mentioned tungsten, molybdenum, manganese, copper, silver, gold, palladium, platinum, nickel, cobalt, or alloys containing them as principal ingredients.

The drive part 5 (FIG. 1A)) has a power supply device 13 which supplies an AC voltage between the first electrode 9 and the second electrode 11 and has a control device 15 which controls the power supply device 13.

The AC voltage supplied by the power supply device 13 may be a voltage which is represented by a sine wave etc. and continuously changes in potential or may be a voltage of a pulse type which discontinuously changes in potential. Further, the AC voltage may be a voltage which fluctuates in potential with respect to the reference potential at both of the first electrode 9 and the second electrode 11 or may be a voltage which fluctuates in potential with respect to the reference potential in only one of the first electrode 9 and second electrode 11 since the other is connected to the reference potential. The potential may fluctuate both positive and negative with respect to the reference potential or may fluctuate to only either positive or negative with respect to the reference potential.

The control device 15 for example controls the ON/OFF application of voltage by the power supply device 13 or the magnitude of the voltage supplied and so on according to a predetermined sequence or operation by the user.

Note that the dimensions of the dielectric 7, first electrode 9, and second electrode 11 and the magnitude and frequency of the AC voltage may be suitably set in accordance with the art in which the ion wind generating device 1 is applied or a demanded property of the ion wind and other various situations.

The method of production of the ion wind generator 3 is, when taking as an example a case where the dielectric 7 is configured by a ceramic sintered body, as follows.

First, a ceramic green sheet which becomes the dielectric 7 is prepared. The ceramic green sheet is formed by adding and mixing a suitable organic solvent with the base powder to prepare a slurry and molding it into a sheet shape by a molding method such as a doctor blade method, a calender roll method, or the like. The base powder is, when taking as an example an alumina ceramic, alumina ($Al_2O_3$), silica ($SiO_2$), calcia (CaO), magnesia (MgO), etc.

Next, a conductive paste which becomes the first electrode 9 is provided on the surface which becomes the first primary surface 7*a* of the ceramic green sheet, and the conductive paste which becomes the second electrode 11 is provided on the surface which becomes the second primary surface 7*b* of the ceramic green sheet.

The conductive paste is prepared for example by adding and mixing an organic solvent and organic binder to metallic powder such as tungsten, molybdenum, copper, silver, or the like. In the conductive paste, according to need, a dispersant, plasticizer, or the like may be added as well. Mixing is carried out by for example a kneading mean such as a ball mill, a triple roll mill, a planetary mixer or the like. Further, the conductive paste is printed on the ceramic green sheet by using for example a printing mean such as a screen printing method or the like.

Further, the conductive pastes and ceramic green sheets are simultaneously fired. Due to this, a dielectric 7 at which the first electrode 9 and second electrode 11 are arranged, that is, the ion wind generator 3, is formed.

Note that, when the conductive paste is fired simultaneously with the ceramic green sheet, for matching with the sintering behavior of the ceramic green sheet or raising the bonding strength with the dielectric after sintering by reduction of remaining stress, a powder of glass or ceramics may be added as well.

Next, the action of the ion wind generating device 1 will be explained.

The ion wind generator 3 is placed in the atmosphere so there is air around the ion wind generator 3. Note that, the ion wind generator 3 may be used while placed in a specific type gas atmosphere (for example in a nitrogen atmosphere).

When voltage is supplied between the first electrode 9 and the second electrode 11 by the power supply device 13, and the potential difference between these electrodes exceeds a predetermined threshold value, a dielectric barrier discharge occurs. Then, plasma is generated accompanied with discharge.

Electrons or ions in the plasma move by the electric field formed by the first electrode 9 and the second electrode 11. Further, neutral molecules move accompanied with the electrons or ions as well. The ion wind is induced in this way.

More specifically, the ion wind flowing on the first primary surface 7*a* side is induced by electrons or ions moving from the side of the first electrode 9 to the side of the second electrode 11 centered at the region on the first primary surface 7*a* which overlaps the second electrode 11 and flows in the direction indicated by the arrows a1 and a2.

At this time, the longer the length "e" of the second electrode 11 (downstream area 11*m*), the faster the ion wind. Accordingly, in the present embodiment, as represented by drawing the arrow a1 large and drawing the arrows a2 small, the nearer to the center side in the y-direction, the higher the velocity (amount of wind). Further, it is also possible to realize a wind direction that gathers the ion wind from the sides to the center as indicated by the arrows b1 because the velocity becomes higher at the position nearer the center in the y-direction.

Note that, the larger the voltage supplied to the first electrode 9 and second electrode 11 or the smaller the distance between the first electrode 9 and the second electrode 11, the greater the velocity. Further, the length in the x-direction of the first electrode 9 (shape of the upstream side edge 9*a*) exerts almost no influence upon the velocity/wind direction of the ion wind on the first primary surface 7*a*.

According to the above first embodiment, the ion wind generator 3 is provided with the first electrode 9, the second electrode 11 having the downstream area 11*m* which is arranged at a position in a plan view shifted to the positive side of the x-direction from the first electrode 9, and the dielectric 7 which is provided between the first electrode 9 and the second electrode 11. In a plan view, the distance "d" in the x-direction from the downstream side edge 9*b* of the first electrode 9 to the downstream side edge 11*b* of the downstream area 11*m* differs in the y-direction which is perpendicular to the x-direction. Accordingly, by utilizing the difference of the distance "d" in the y-direction, for example, the length "e" in the x-direction can be made different in the y-direction and thereby the velocity can be diversified.

Further, the downstream side portion of the first electrode 9 and the upstream side portion of the second electrode 11 are adjacent in the x-direction across the downstream side edge 9*b* of the first electrode 9. Accordingly, the dependency of the velocity upon the distance "d" rises, so adjustment of velocity etc. is easy. That is, when the downstream side portion of the first electrode 9 and the upstream side portion of the second electrode 11 are spaced apart in the x-direction, and the distance of that changes, a variation is caused in occurrence of discharge, and even the change of the velocity accompanied with that variation must be considered. However, such inconvenience does not occur.

The downstream area 11*m* is formed so that the length "e" in the x-direction becomes large at the center in the y-direction. Accordingly, as explained above, the velocity can be made higher at a position nearer the center of the y-direction and the wind direction which gathers the ion wind to the center becomes possible. Due to this, for example, when utilizing the ion wind generating device 1 for modification and discharge of a fluid, spread of the fluid which has not yet been sufficiently modified to the periphery of the ion wind generating device 1 is suppressed and so on. In this way, various effective utilizations of the ion wind generating device 1 become possible.

Note that, in the first embodiment, the direction to the positive side in the x-direction is one example of the first direction of the present invention, and the y-direction is one example of the second direction of the present invention.

<Second Embodiment>

Figure 2:
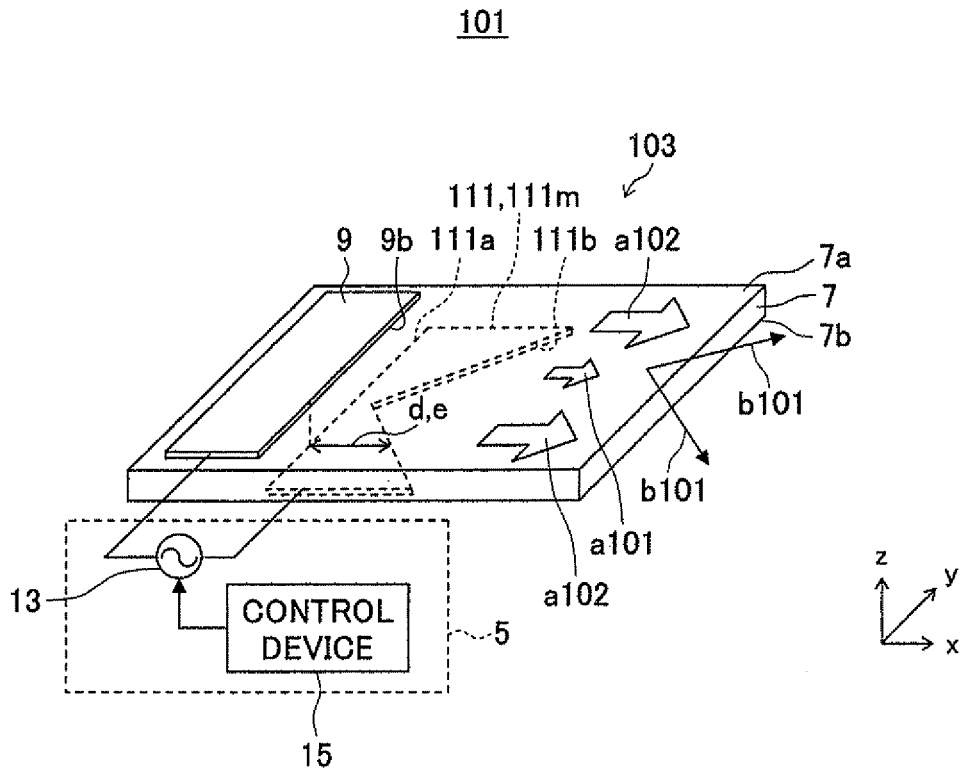
[FIG. 2 ]FIG. 2 A perspective view which schematically shows principal parts of an ion wind generating device according to a second embodiment of the present invention.

FIG. 2 is a perspective view which schematically shows principal parts of an ion wind generating device 101 according to a second embodiment of the present invention.

The ion wind generating device 101 differs from the ion wind generating device 1 in the first embodiment in only the shape of a second electrode 111 (downstream side edge 111*m*) of an ion wind generator 103. Specifically, the second electrode 111 is shaped comprised of two right-angled triangles arranged so that the center of the downstream side edge 111*b* is recessed. In other words, as opposed to the first embodiment, the second electrode 111 is formed so that its length "e" in the x-direction becomes large at the two end sides in the y-direction. Note that, in a plan view, the downstream side edge 9*b* of the first electrode 9 and an upstream side edge 111*a* of the second electrode 111 are adjacent. This is the same as the first embodiment.

Accordingly, in the second embodiment, as indicated by arrows a101 and a102 which are made different in size, as opposed to the first embodiment, the velocity becomes higher toward the sides. Further, by the velocity which becomes higher at the sides, as indicated by the arrows b101, a wind direction that makes the ion wind scatter to the sides can be realized. Due to this, for example, a fluid can be efficiently dispersed to the periphery and so on. Thus, various effective utilizations of the ion wind generating device 101 become possible.

<Third Embodiment>

Figure 3A:
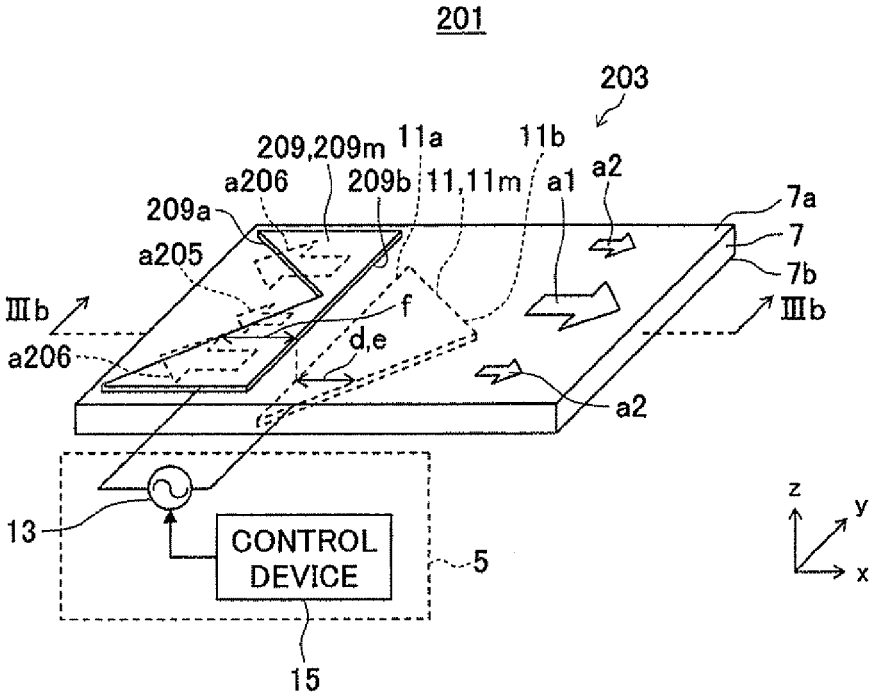
FIG. 3A is a perspective view which schematically shows an ion wind generating device according to a third embodiment of the present invention.
Figure 3B:
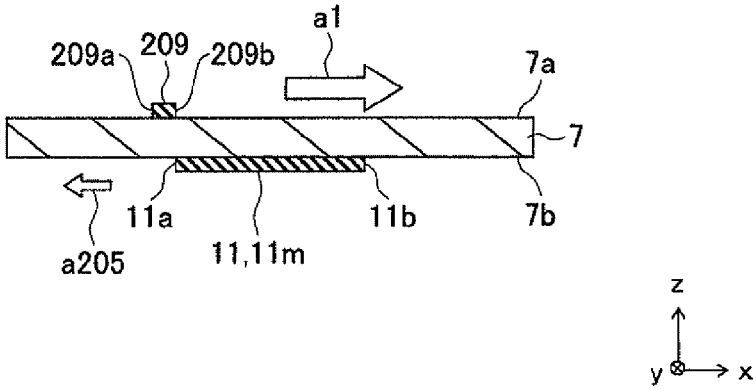
FIG. 3B is a cross-sectional view along an IIIb-IIIb line in FIG. 3A.

FIG. 3A is a perspective view which schematically shows an ion wind generating device 201 according to a third embodiment of the present invention, and FIG. 3B is a cross-sectional view along an IIIb-IIIb line in FIG. 3A.

The ion wind generating device 201 differs from the ion wind generating device 1 in the first embodiment in only the shape of a first electrode 209 of an ion wind generator 203. Specifically, this is as follows.

The first electrode 209 has an upstream area 209*m* which is located on the upstream side other than the second electrode 11. Note that, in the same way as the first embodiment, in a plan view, a downstream side edge 209*b* of a first electrode 209 and the upstream side edge 11*a* of the second electrode 11 are adjacent. The upstream area 209*m* is the first electrode 209 as a whole in the present embodiment.

The first electrode 209 is shaped comprised of two right-angled triangles arranged so that the center of the upstream side edge 209*a* is recessed. On the other hand, the second electrode 11 is a triangle with a center of the downstream side edge 11*b* projecting out. Accordingly, the first electrode 209 roughly forms the shape of a rectangle from which a region equivalent to the second electrode 11 is cut. In other words, in the first electrode 209, a length "f" in the x-direction becomes larger at a position in the y-direction where the length "e" in the x-direction of the second electrode 11 (downstream area 11*m*) becomes smaller.

When an AC voltage is supplied to the first electrode 209 and second electrode 11, as indicated by arrows a205 and a206, an ion wind is generated not only on the first primary surface 7*a*, but also on the second primary surface 7*b*. This latter ion wind is induced centered at the region on the second primary surface 7*b* which overlaps the first electrode 209 and flows from the side of the second electrode 11 to the side of the first electrode 209 (in an inverse direction to that of the ion wind flowing on the first primary surface 7*a*).

At this time, the longer the length "f" of the first electrode 209 (upstream area 209*m*), the faster the ion wind on the second primary surface 7*b*. Accordingly, in the present embodiment, as represented by drawing the arrow a205 small and drawing the arrows a206 large, the velocity (amount of wind) becomes higher toward the two end sides in the y-direction.

Here, on the first primary surface 7*a*, in the same way as the first embodiment, the velocity (amount of wind) becomes smaller toward the two end sides in the y-direction. Accordingly, the effect of reduction of the velocity of the ion wind on the first primary surface 7*a* by the ion wind on the secondary primary surface 7*b* becomes greater at the position where the velocity of the ion wind on the first primary surface is smaller. As the result, an ion wind having large difference in velocity can be realized.

<Fourth Embodiment>

Figure 4A:
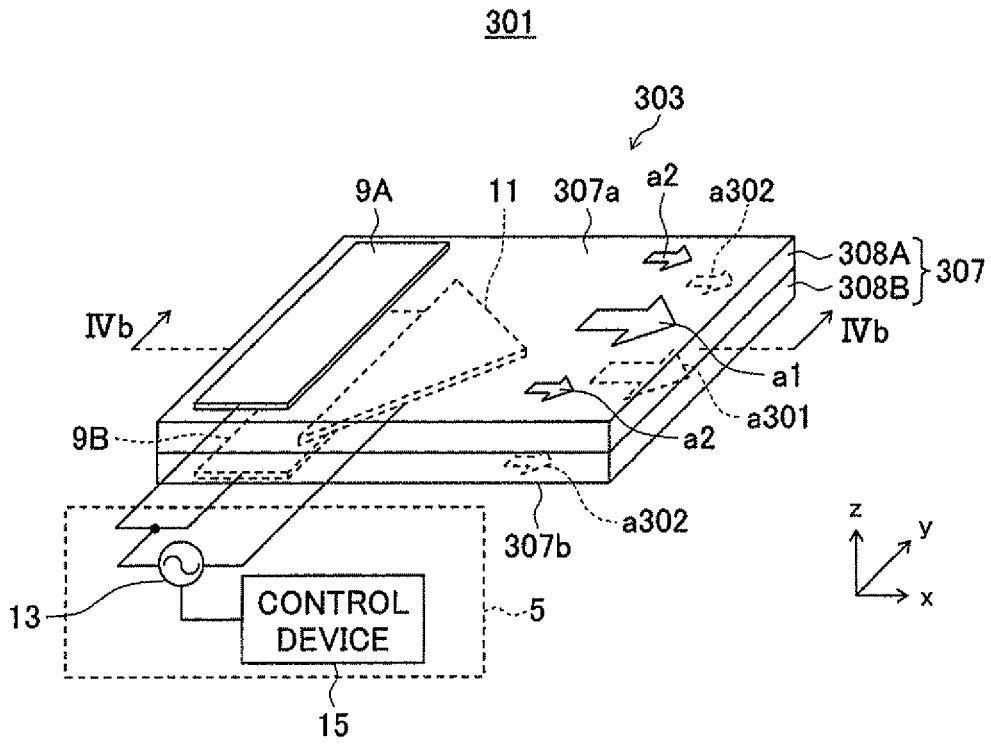
FIG. 4A is a perspective view which schematically shows an ion wind generating device according to a fourth embodiment of the present invention.
Figure 4B:
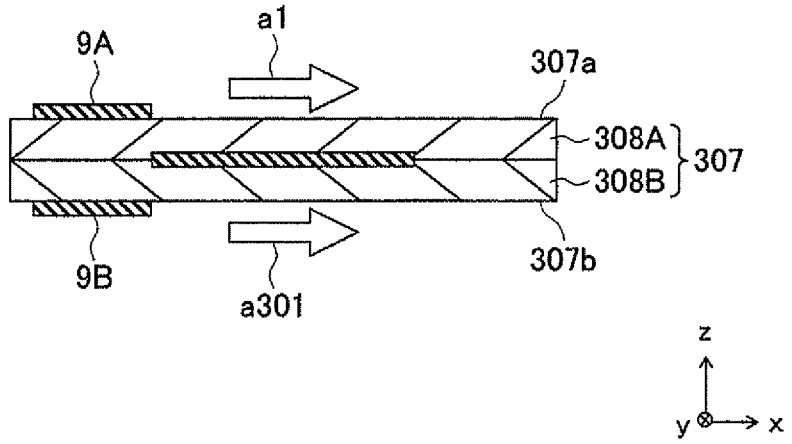
FIG. 4B is a cross-sectional view along an IVb-IVb line in FIG. 4A.

FIG. 4A is a perspective view which schematically shows an ion wind generating device 301 according to a fourth embodiment of the present invention, and FIG. 4B is a cross-sectional view along an IVb-IVb line in FIG. 4A.

An ion wind generator 303 of an ion wind generating device 301, if schematically explained with reference to the notations in FIG. 1, is configured as the ion wind generator 3 in the first embodiment plus a dielectric 7 and first electrode 9 at the second primary surface 7*b* side. If specifically explained with reference to the notations in FIG. 4, it is as follows.

A dielectric 307 has a first primary surface 307*a* and a second primary surface 307*b* at the back thereof. First electrodes 9A and 9B are respectively laid on the first primary surface 307*a* and the second primary surface 307*b*, while the second electrode 11 is buried in the dielectric 307. The configuration (shapes and positions of members) of the ion wind generator 303 becomes plane symmetric with respect to the second electrode 11.

The dielectric 307 is for example configured by lamination of a first insulation layer 308A and a second insulation layer 308B. Note that, in FIG. 4, for convenience of explanation, a borderline between the first insulation layer 308A and the second insulation layer 308B is clearly shown. However, in the actual product, the first insulation layer 308A and second insulation layer 308B may be integrally formed and the borderline not be observable. Note that, even if the borderline cannot be observed, it is possible to identify its position from the position of the second electrode 11.

Each of the first electrodes 9A and 9B is the same as the first electrode 9 in the first embodiment. They are connected in parallel to each other. Further, the second electrode 11 is the same as the second electrode 11 in the first embodiment as well except for the point that it is buried in the dielectric 307.

The method of production of the ion wind generator 303 may be for example a method of firing ceramic green sheets at which conductive pastes which become the electrodes are provided in the same way as the first embodiment. That is, the ion wind generator 303 may be formed by arranging a conductive paste which becomes the first electrode 9A on a ceramic green sheet which becomes the first insulation layer 308A, arranging a conductive paste which becomes the first electrode 93 on a ceramic green sheet which becomes the second insulation layer 308B, arranging a conductive paste which becomes the second electrode 11 at one of the above two ceramic green sheets, laminating the above two ceramic green sheets, and firing the assembly.

In the ion wind generator 303, when an AC voltage is supplied between the first electrodes 9A and 9B and the second electrode 11, as indicated by the arrows a1 and a2, on the first primary surface 307*a*, in the same way as the first embodiment, an ion wind from the first electrode 9A side to the second electrode 11 side is generated. Further, as indicated by arrows a301 and a302, on the second primary surface 307*b* as well, an ion wind from the first electrode 9B side to the second electrode 11 side is generated. That ion winds in the same direction are generated on the first primary surface 307*a* and second primary surface 307*b*. Accordingly, ion winds having high velocities can be efficiently generated.

<Fifth Embodiment>

Figure 5:
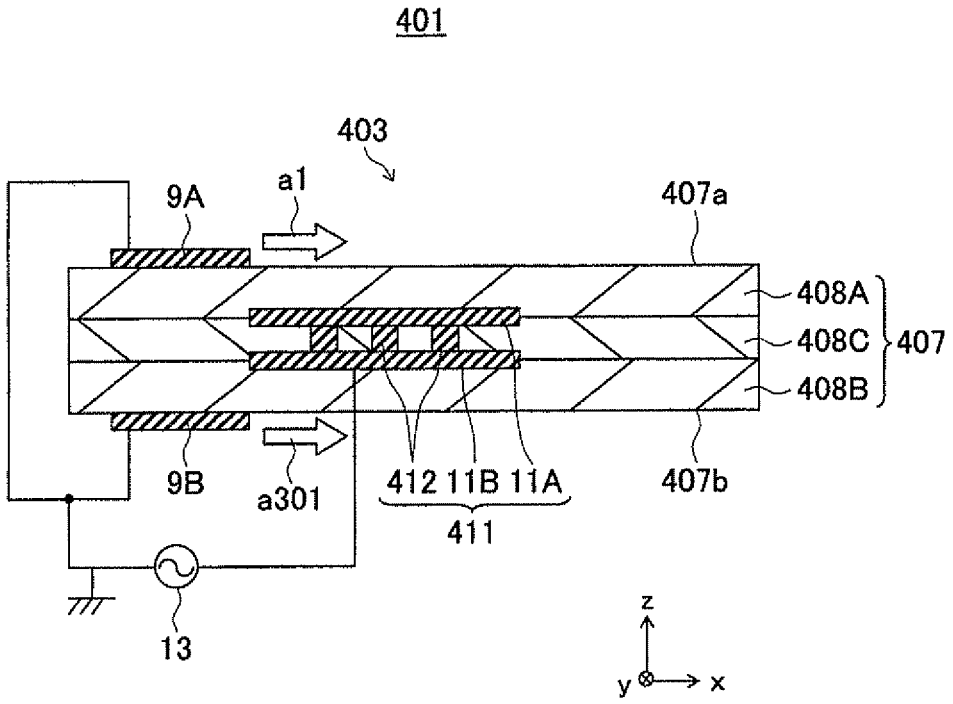
[FIG. 5 ]A cross-sectional view which schematically shows principal parts of an ion wind generating device according to a fifth embodiment of the present invention.

FIG. 5 is a cross-sectional view which schematically shows principal parts of an ion wind generating device 401 according to a fifth embodiment of the present invention.

An ion wind generator 403 of the ion wind generating device 401 has first electrodes 9A and 9B arranged on the two primary surfaces of a dielectric 407 in the same way as the fourth embodiment. Note, the configurations of the dielectric and second electrode are different from those in the fourth embodiment.

An ion wind generator 403, if schematically explained with reference to the notations in FIG. 1, is configured as two ion wind generator 3 in the first embodiment superposed with a third insulation layer 408C interposed therebetween. If specifically explained with reference to the notations in FIG. 4, it is as follows.

The dielectric 407 is configured by lamination of a first insulation layer 408A and second insulation layer 408B and the third insulation layer 408C interposed between them. The first insulation layer 408A and second insulation layer 408B have for example the same thicknesses as each other. The thickness of the third insulation layer 408C may be suitably set. FIG. 3 exemplifies a case where it is formed thinner than the first insulation layer 408A and second insulation layer 408B.

The dielectric 407 has a first primary surface 407*a* and a second primary surface 407*b* at the back thereof. The first electrodes 9A and 9B are respectively laid on the first primary surface 407*a* and second primary surface 407*b*. The second electrodes 11A and 11B are respectively buried between the first insulation layer 408A and the third insulation layer 408C and between the second insulation layer 408B and the third insulation layer 408C.

The third insulation layer 408C is provided with via conductors 412 passing through the third insulation layer 408C. The via conductors 412 connect the second electrodes 11A and 11B. The number, arrangement, planar shape, cross-sectional shape, and dimensions of the via conductors 412 may be suitably set. The material of the via conductors 412 is for example the same as the material of the first and second electrodes.

Note that, it may be grasped that the second electrode 411 in the fifth embodiment is configured by the second electrodes 11A and 11B and via conductors 412 as a whole.

Each of the first electrodes 9A and 9B is the same as the first electrode 9 in the first embodiment. They are connected to each other. Further, the second electrodes 11A and 11B are the same as the second electrode 11 in the first embodiment as well except for the point that they are buried in the dielectric 407.

The method of production of the ion wind generator 303 may be for example a method of firing the ceramic green sheets at which the conductive pastes which become the electrodes are provided in the same way as the first embodiment. Specifically, the method is as follows.

Conductive pastes which become the first electrode 9A and the second electrode 11A are arranged at the ceramic green sheet which becomes the first insulation layer 408A. Further, conductive pastes which become the first electrode 9B and second electrode 11B are arranged at the ceramic green sheet which becomes the second insulation layer 408B. Further, vias are formed in the ceramic green sheet which becomes the third insulation layer 408C, and conductive paste which becomes the via conductors 412 is filled in those vias. By laminating and firing the above three ceramic green sheets, the ion wind generator 403 is formed.

In the ion wind generator 403 as well, in the same way as the fourth embodiment, ion winds in the same direction can be generated at both of the first primary surface 407*a* and second primary surface 407*b*, and ion winds having high velocities can be efficiently generated.

In the ion wind generator 303 of the fourth embodiment, if making the first insulation layer 308A and second insulation layer 308B thinner in order to make the distances of the first electrodes 9A and 9B from the second electrode 11 small and make the velocities of the ion winds high, the thickness of the dielectric 307 becomes small as a whole, so the mechanical strength of the ion wind generator 303 is lowered. In the ion wind generator 403 of the fifth embodiment, however, due to the third insulation layer 408C, it is possible to secure the thickness of the dielectric 407 as a whole.

Further, in the ion wind generator 303 of the fourth embodiment, positional deviation when laminating the first insulation layer 308A and second insulation layer 308B is liable to cause position deviation between the second electrode 11 and one of the first electrodes 9A and 9B. In the fifth embodiment, however, such an inconvenience does not occur.

<Sixth Embodiment>

Figure 6A:
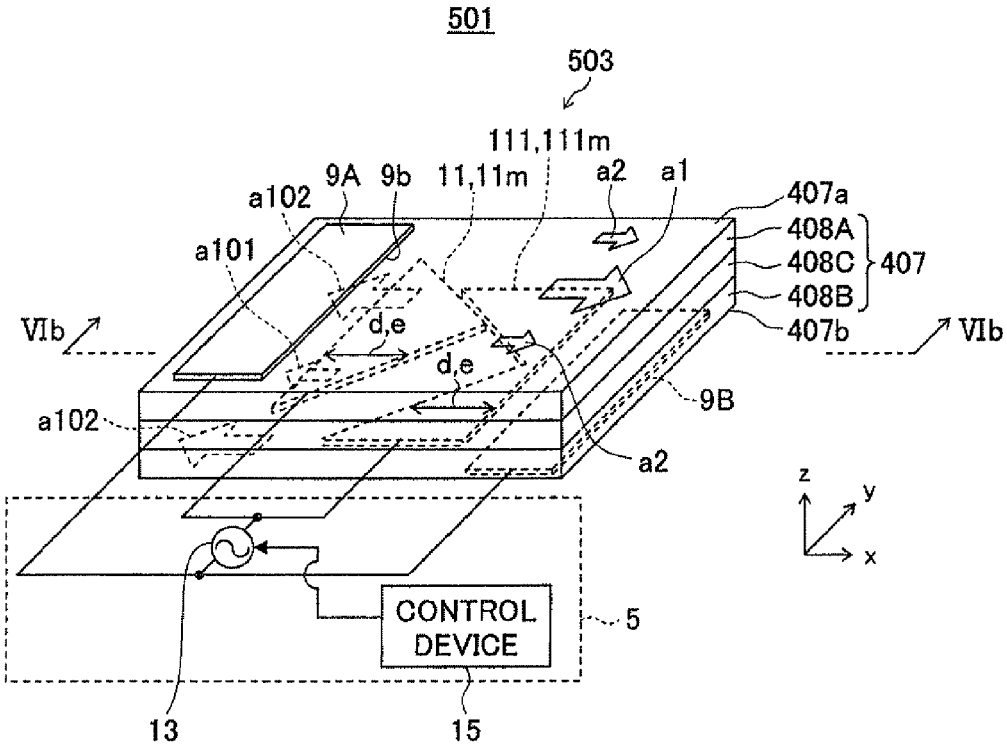
FIG. 6A is a perspective view which schematically shows an ion wind generating device according to a sixth embodiment of the present invention.
Figure 6B:
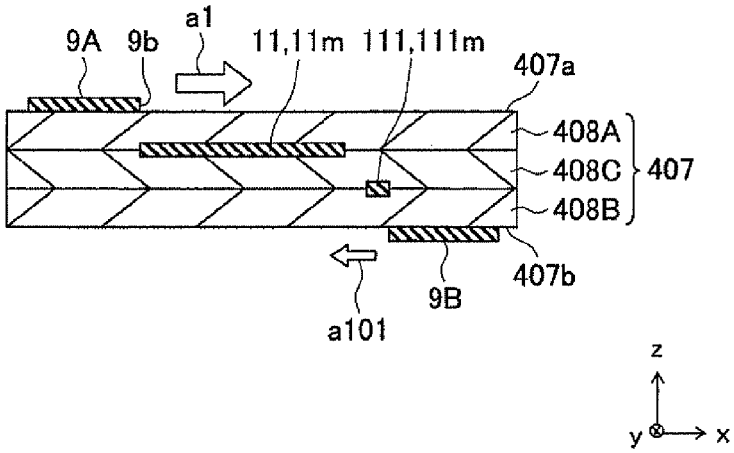
FIG. 6B is a cross-sectional view along a VIb-VIb line in FIG. 6A.

FIG. 6A is a perspective view which schematically shows an ion wind generating device 501 according to a sixth embodiment of the present invention, and FIG. 6B is a cross-sectional view along a VIb-VIb line in FIG. 6A.

In an ion wind generator 503 of the ion wind generating device 501, in the same way as the fifth embodiment, the first electrodes 9A and 9B are arranged at the two primary surfaces of a dielectric 407, and two second electrodes are buried in the dielectric 407. Note, the arrangement and configurations of the electrodes differ from those in the fifth embodiment.

The ion wind generator 503, if schematically explained with reference to the notations in FIG. 1 and FIG. 2, is configured by ion wind generator 3 in the first embodiment and the ion wind generator 103 in the second embodiment superimposed on each other with a third insulation layer 408C interposed therebetween. The first electrodes 9A and 9B are connected in parallel to each other, and the second electrodes 11 and 111 are connected in parallel to each other.

The direction from the first electrode 9A to the second electrode 11, and the direction from the first electrode 9B to the second electrode 111 become inverse to each other. In other words, that the second electrode 11 has the downstream area 11*m* which is located nearer one side in the x-direction than the first electrode 9A, while the second electrode 111 has a downstream area 111*m* which is located nearer the other side in the x-direction than the first electrode 9B. Accordingly, the ion wind along the first primary surface 407*a* and the ion wind along the second primary surface 407*b* are inverse in direction.

Further, the shape of one of the second electrode 11 and the second electrode 111 roughly forms the shape of a rectangle from which a region equivalent to the shape of the other electrode is cut. In other words, a length "e" in the x-direction of the downstream area 111*m* of the second electrode 111 becomes larger at the position in the y-direction where the length "e" in the x-direction of the downstream area 11*m* of the second electrode 11 is smaller.

When an AC voltage is supplied to the first electrode 9A and second electrode 11, as indicated by the arrows a1 and a2, on the first primary surface 407*a*, ion wind the same as that in the first embodiment is generated. Further, when an AC voltage is supplied to the first electrode 9B and second electrode 111, as indicated by arrows a101 and a102, ion wind the same as that in the second embodiment is generated on the second primary surface 407*b*.

Here, the ion wind on the first primary surface 407*a* and the ion wind on the second primary surface 407*b* are inverse in direction. Further, with regard to position in the y-direction, the smaller the velocity of the ion wind on the first primary surface 407*a* is, the greater the velocity of the ion wind on the second primary surface 407*b* is. Accordingly, in the same way as the third embodiment, the effect that the velocity becomes relatively large at the center in the y-direction in the ion wind on the first primary surface 407*a* increases.

Note that, in the sixth embodiment, the first electrodes 9A and 9B are one example of the first electrode and third electrode of the present invention, and the second electrodes 11 and 111 are one example of the second electrode and fourth electrode of the present invention.

<Seventh Embodiment>

Figure 7:
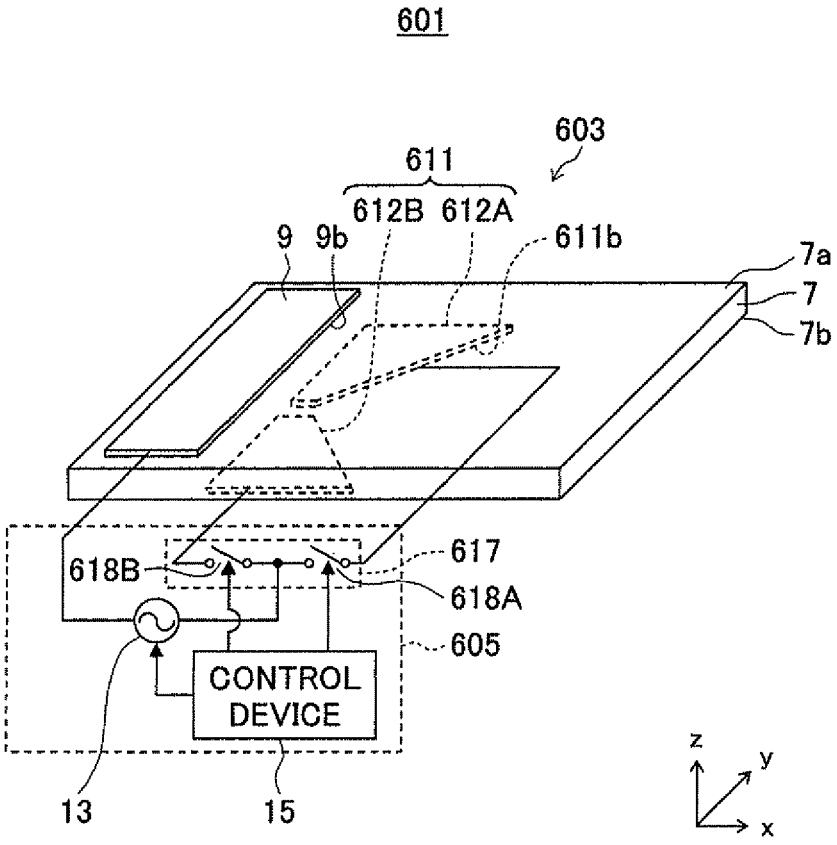
[FIG. 7 ]A perspective view which schematically shows an ion wind generating device according to a seventh embodiment of the present invention.

FIG. 7 is a perspective view which schematically shows an ion wind generating device 601 according to a seventh embodiment of the present invention.

The ion wind generating device 601 differs from the first embodiment etc. in the electrode shape of the second electrode and the voltage control of the second electrode. Specifically, this is as follows.

A second electrode 611 of an ion wind generator 603 is divided into several parts (two in the present embodiment) in the y-direction, so has a first divided electrode 612A and second divided electrode 612B (hereinafter, sometimes simply referred to as the "divided electrodes 612"). Note that, the second electrode 611 may have a suitable shape as a whole. In FIG. 7, however, in the same way as the second embodiment, a case where two right-angled triangles are arranged so that the downstream side edge 611*b* is recessed at the center is exemplified.

Further, a drive part 605 has a switch part 617 capable of switching the connection state of the power supply device 13 with the two divided electrodes 612. The switch part 617 is for example configured by switches 618 (618A, 618B) which are provided for any divided electrodes 612 (for all divided electrodes 612 in the present embodiment). Further, the switch part 617 can switch the connection state between the power supply device 13 and the two divided electrodes 612 among four states of a state where the two divided electrodes 612 are connected, a state where only the first divided electrode 612A is connected, a state where only the second divided electrode 612B is connected, and a state where the two divided electrodes 612 are disconnected. The switch 618 is configured by for example an FET (field effect transistor).

According to the seventh embodiment, by switching the connection state between the power supply device 13 and the divided electrodes 612, the velocity and/or wind direction can be made variable, so the effect of diversification of the velocity and/or wind direction according to the change of the shape of the second electrode 611 can be increased. As the result, for example, a small electronic apparatus which utilizes ion wind as the driving force can be made to perform a variety of motions. Further, because the switch part 617 is used to select the electrode which is supplied with a voltage, the price is cheap compared with the case where a plurality of power supply devices 13 are arranged corresponding to a plurality of divided electrodes 612 (this case is included in the invention of the present application as well).

<Eighth Embodiment>

Figure 10:
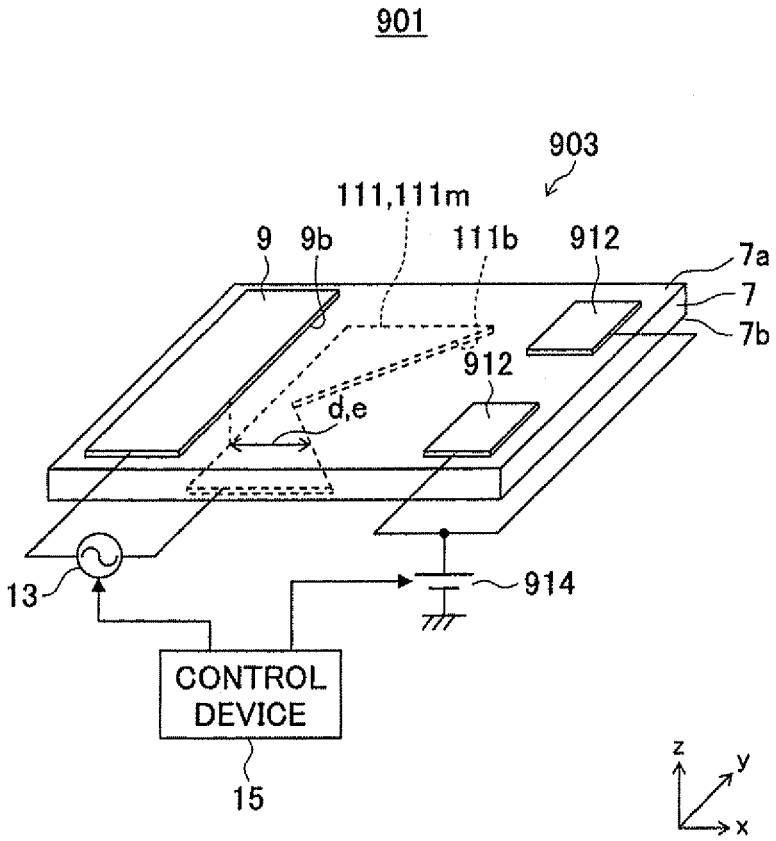
[FIG. 10 ]A perspective view which schematically shows an ion wind generating device according to an eighth embodiment of the present invention.

FIG. 10 is a perspective view which schematically shows an ion wind generating device 901 according to an eighth embodiment of the present invention.

The ion wind generating device 901 is configured as the ion wind generating device 101 in the second embodiment where DC electrodes 912 and a DC power supply device 914 which supplies DC voltage to the DC electrodes 912 are provided. Specifically, the configuration is as follows.

The DC electrode 912 is for example formed in a flat sheet shape in the same way as the first electrode 9 etc, and is provided on the downstream side from the second electrode 111 on the first primary surface 7*a*. Further, two DC electrodes 912 are provided at the two sides in the y-direction. In other words, the DC electrodes 912 are provided at positions in the y-direction where the length "e" in the x-direction of the second electrode 111 has become large. Note that, the shapes of the DC electrodes 912 may be suitable ones.

The DC power supply device 914 supplies a DC voltage to the DC electrodes 912 in a state where a closed loop is not formed. That is, at the DC electrode 912, only a positive terminal or negative terminal of the DC power supply device 914 is connected, so a closed loop in which current from the DC power supply device 914 flows is not formed. Note that, in FIG. 10, the two DC electrodes 912 are connected in parallel with respect to the DC power supply device 914, but they may be connected in series as well.

When a DC voltage is supplied to the DC electrodes 912 by the DC power supply device 914, an electric field is formed around the DC electrode 912. Accordingly, electrons or ions contained in plasma (ion wind) are attracted to the DC electrode 912 side. For example, when a positive potential given to the DC electrode 912, negative charges are attracted to the DC electrode 912. When a negative potential is given to the DC electrode 912, positive charges are attracted to the DC electrode 912. As the result, the ion wind is accelerated. In addition, the DC electrode 914 does not form a closed loop, therefore the consumed power is extremely low.

Further, the DC electrodes 912 are arranged at positions where the velocity becomes high according to the shape of the second electrode 111, therefore the distribution of velocity due to the second electrode 111 can be made more conspicuous.

Note that, the control device 15 may perform control so that the DC power supply device 914 constantly supply a DC voltage to the DC electrodes 912 during the period where the power supply device 13 supplies an AC voltage to the first electrode 9 and second electrode 111 or may perform control so that the DC power supply device 914 supplies a DC voltage to the DC electrodes 912 during the period where the power supply device 13 supplies an AC voltage to the first electrode 9 and second electrode 111 only at the time when predetermined conditions are satisfied. Further, the control device 15 may control the magnitude of the DC voltage as well. In this case, the magnitude of the DC voltage may be controlled so as to be proportional to the magnitude of the AC voltage or may be controlled independently from the magnitude of the AC voltage.

<Example of Utilizations>

Figure 8:
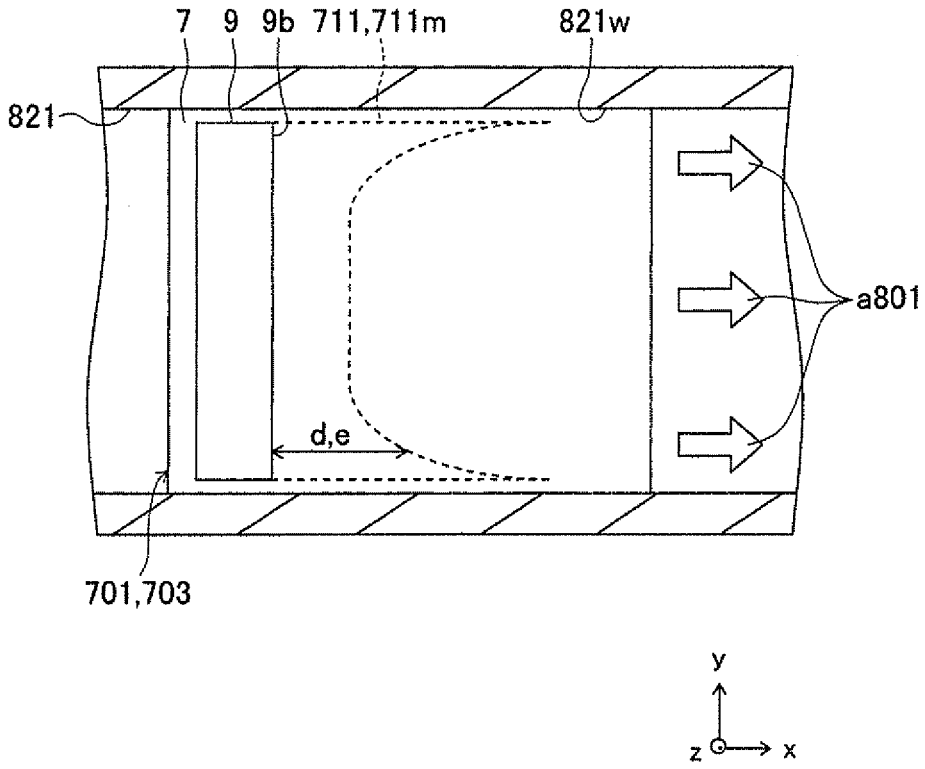
[FIG. 8 ]A cross-sectional view which schematically shows principal parts of an example of utilization of the ion wind generating device of the present invention.
Figure 11:
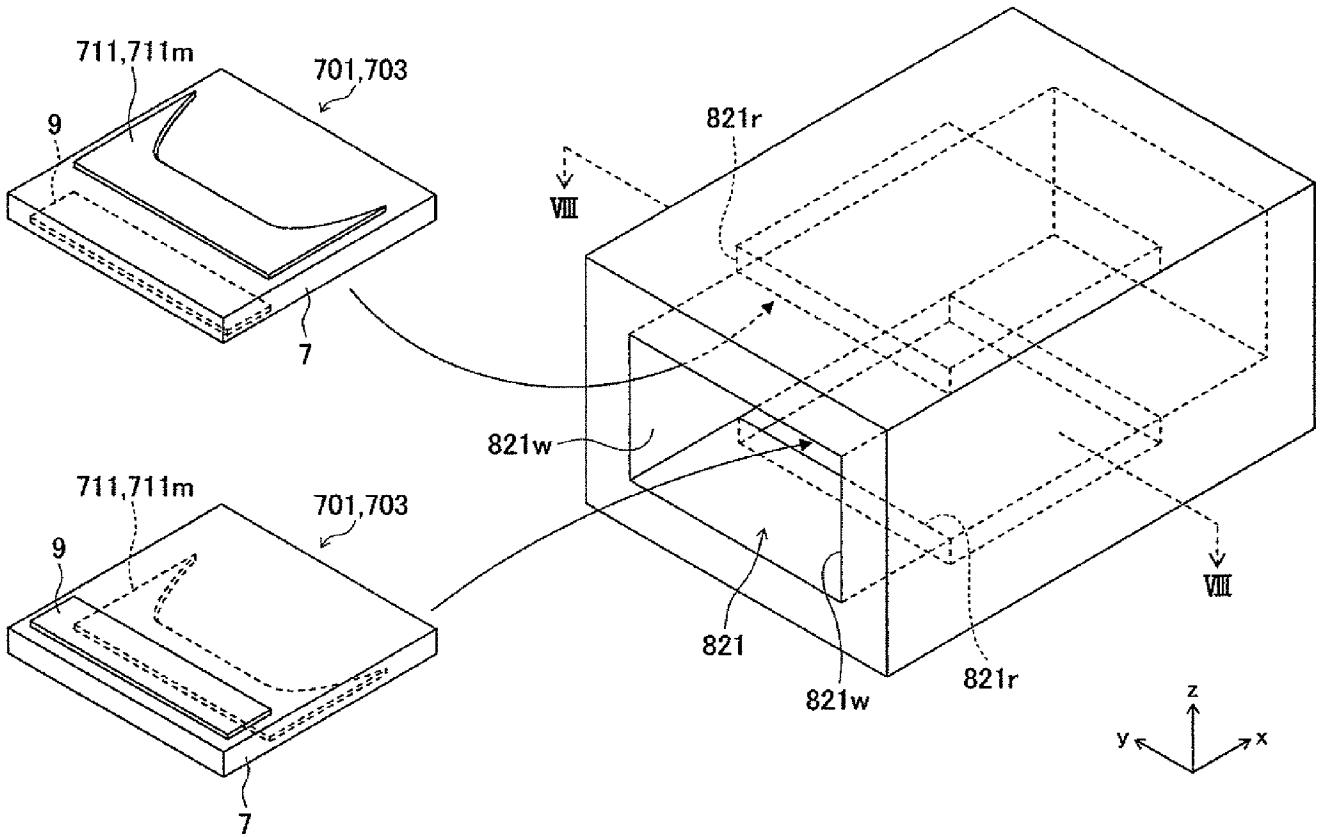
[FIG. 11 ]A disassembled perspective view which schematically shows principal parts of an example of utilization of FIG. 8.

FIG. 11 is a disassembled perspective view which schematically shows principal parts of an example of utilization of the ion wind generating device of the present invention, and FIG. 8 is a cross-sectional view along a VIII-VIII line in FIG. 11.

Ion wind generating devices 701 in the example of utilization are arranged in concave portions 821*r* formed in the top surface and bottom surface of a passage 821 and are utilized for causing a flow in the x-direction in the passage 821. In such a case, in the vicinity of the wall surface 821*w* of the passage 821, the flow rate becomes low due to a frictional resistance from the wall surface 821*w*, so the distribution of flow rate in the passage 821 becomes non-uniform.

Accordingly, in the same way as the second embodiment, second electrodes 711 (downstream areas 711*m*) of an ion wind generator 703 are formed so that their lengths "e" in the x-direction (FIG. 8) become long at the end sides in the y-direction.

Accordingly, due to induction of ion winds so that their velocities become high in the vicinity of the wall surface

821*w*, as indicated by arrows a801 in FIG. 8, the non-uniformity of flow rate due to the influence of the wall surface 821*w* is eased.

Note that, in the passage, the shape of the cross-section perpendicular to the flow direction is not limited to a rectangle and may be a circle etc. Further, the bottom surface and top surface of the passage 821 as a whole or members configuring the passage 821 as a whole may be formed by a dielectric as well. In the case where the members configuring the passage 821 as a whole are a dielectric, the second electrodes 711 may be provided on the outer circumferential surfaces of the members as well. Further, the ion wind generator may be formed so that ion winds flow in the same direction on the two primary surfaces of the dielectric as in the fourth embodiment, a plurality of ion wind generators may be arranged at predetermined intervals in the z-direction in the passage, and a plurality of generators may be arranged at predetermined intervals in the y-direction by changing the orientation by 90 degrees around the x-axis.

The present invention is not limited to the above embodiments and may be executed in various ways.

The ion wind generating devices and ion wind generators of the present invention can be utilized in a variety of fields. For example, the present invention may be utilized for suppressing peeling of a boundary layer in a wing or may be utilized in formation of a flow in a small space (for example formation of cooling air in a compact electronic apparatus).

The plurality of embodiments explained above may be suitably combined. For example, the configuration of arranging first electrodes at the two surfaces of the dielectric in the fourth and fifth embodiments may be applied to the shape of the second electrode in the second embodiment. Further, for example the configuration of dividing the second electrode in the seventh embodiment may be applied to the shape of the second electrode in the first embodiment. Further, for example the DC electrodes of the eighth embodiment may be added to any embodiment other than the second embodiment as well.

The dielectric is not limited to a flat sheet shaped one and may be for example a blade shaped one having a thickness which changes or may be a curved sheet shaped one. The dielectric in which the second electrode etc. are buried is not limited to one formed by lamination of insulation layers. For example, the dielectric may be one formed by filling the material which forms the dielectric in a mold in which metal forming the electrode is arranged and molding the same. Further, in a case where the dielectric is formed by lamination of insulation layers, the dielectric is not limited to one obtained by laminating and firing ceramic green sheets. For example, the dielectric may be one obtained by lamination of insulation layers by thermal spraying of a ceramic or may be one obtained by lamination and hot pressing of an uncured thermosetting resin. Further, in the case where the insulation layer is formed by a ceramic green sheet, one insulation layer may be formed by a plurality of ceramic green sheets as well. Further, the dielectric may isolate the first electrode and the second electrode and need not function as the base for fastening these electrodes.

The first electrode has only to have a certain degree of width in a direction (second direction) perpendicular to the direction in which it lines up with the downstream area of the second electrode (flow direction of the ion wind, i.e., the first direction), it may be a suitable shape. For example, the first electrode may be a shaft shape extending in the second direction as well. Further, in the case where the first electrode is layer shaped, the planar shape thereof is not limited to ones in the embodiments. For example, the planar shape may be circle, square, or trapezoid. Further, the first electrode may be larger in length in the first direction than the length in the second direction.

In a case where the first electrodes are provided at the both primary surfaces of the dielectric, the two first electrodes may have shapes different from each other as well. Further, in the case where the first electrodes are provided at both primary surfaces of the dielectric, they are not limited to ones which are connected in parallel. For example, the first electrodes provided at both primary surfaces may be connected in series, or voltages having frequencies and/or amplitudes which are different from each other may be supplied between them and the second electrodes. This is also the same for the case where two second electrodes are provided inside the dielectric.

The second electrode is not limited to the electrode in which, in a plan view, the position of the upstream side edge of the second electrode coincides with the position of the upstream side edge of the first electrode. For example, as exemplified in the plan views of FIG. 9A to FIG. 9C, the second electrode may be formed so as to partially overlap or be spaced from the first electrode in the x-direction across the downstream side edge of the first electrode or across the upstream side edge of the second electrode.

Figure 9A:
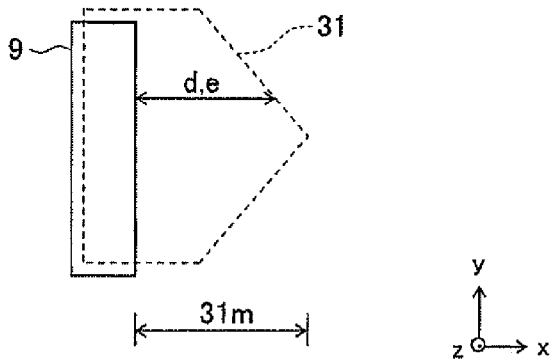
FIG. 9A to FIG. 9C are schematic plan views showing modifications of the electrode.

In FIG. 9A, a portion of the upstream side of the second electrode 31 overlaps the first electrode 9. Note that, in this case, unlike the embodiments, the downstream area 31*m* of the second electrode 31 becomes a portion of the downstream side of the second electrode 31. The distance "d" and the length "e" are the same as each other. However, unlike the embodiments, the distance "d" and the length "e" are different from the length in the x-direction of the second electrode 31 as a whole. A portion of the upstream side of the second electrode 31 may overlap the first electrode 9 as a whole.

Figure 9B:
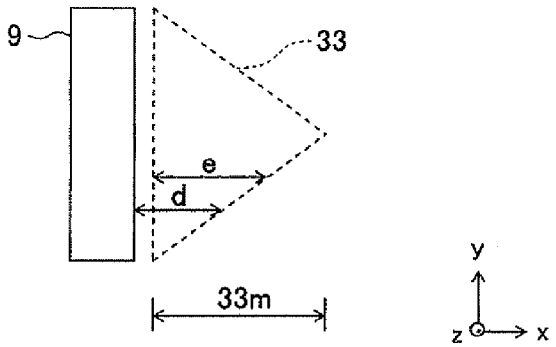

In FIG. 9B, the second electrode 33 is spaced apart from the first electrode 9. Note, the distance of spacing (distance in the x-direction) is constant in the y-direction. Note that, in this case, in the same way as the embodiments, the downstream area 33*m* of the second electrode 33 becomes the second electrode 33 as a whole. The distance "d" and the length "e" at the same position in the y-direction are different from each other. However, the change of the distance "d" and the length "e" with respect to the position in the y-direction are the same as each other.

Figure 9C:
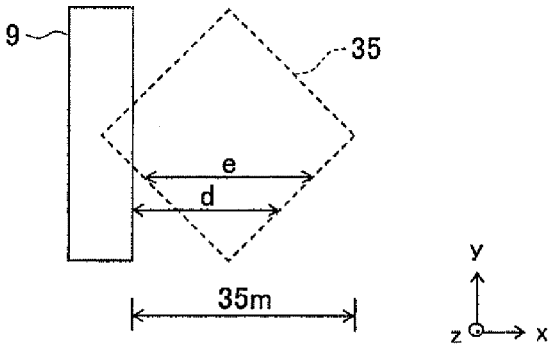

In FIG. 9C, the second electrode 35 overlaps the first electrode 9 in only a portion in the y-direction. Further, for the spaced portion, the distance of spacing (distance in the x-direction) is not constant in the y-direction. Note that, in this case, unlike the embodiments, the downstream area 35*m* of the second electrode 35 becomes a portion of the downstream side of the second electrode 35. In the spaced portion, the distance "d" and the length "e" at the same position in the y-direction are different from each other, and changes of the distance "d" and the length "e" with respect to the position in the y-direction are different from each other.

The distance (d) from the downstream side edge of the first electrode to the downstream side edge of the second electrode changes with respect to the position in the second direction, while the length (e) in the first direction of the downstream area of the second electrode may be constant with respect to the position in the second direction. In this case as well, it is possible to diversify the velocity and/or amount of wind according to the change of the distance in the first direction between the downstream side edge of the first electrode and the upstream side edge of the second electrode with respect to the position in the second direction. However, it is considered that the velocity and/or amount of wind can be changed more efficiently in the case where the length (e) of the downstream area changes.

The change of the length (e) of the downstream area of the second electrode with respect to the position in the second direction (y-direction) is not limited to ones exemplified in the embodiments. For example, it need not linearly change, but may change in a curve or change in steps. Further, the change of the length (e) may be complex. For example, the length (e) may increase or decrease at a suitable number of suitable positions, or the length (e) may asymmetrically change with respect to the center of the downstream side edge of the first electrode (center of the y-direction).

In the case, like in the third embodiment, where the length (f) of the upstream area of the first electrode changes with respect to the position in the second direction (y-direction), the shape of the first electrode is not limited to a shape of a rectangle from which the shape of the second electrode is cut. The shape of the first electrode may be suitably set so that a suitable ion wind is compounded from the ion winds on the two primary surfaces. This is also the same for the shape of the fourth electrode in the case, like in the sixth embodiment, where the length (e) of the downstream area of the fourth electrode (111) changes with respect to the position in the second direction.

The first electrode (or third electrode) is not limited to one exposed at the surface of the dielectric. The first electrode may be buried in the dielectric or may be coated by a dielectric material. Further, in the case where the first electrode is exposed at the surface of the dielectric, the first electrode may be fitted in a concave portion formed in the dielectric, and only a portion may be exposed from the dielectric as well.

The second electrode (or fourth electrode) may be suitably arranged at the surface of the dielectric, inside it, in a concave portion, or the like in the same way as the first electrode. Note that, when taking note of only the ion wind on the first primary surface as in the first embodiment, by burying the second electrode and making the thickness of the dielectric between the second electrode and the second primary surface large, generation of the ion wind on the second primary surface can be suppressed.

The switch configuring the switch part may be suitably provided with respect to a plurality of second electrodes and does not have to be individually provided for all of the second electrodes. For example, the switch may be individually provided with respect to a portion among a plurality of second electrodes or may be commonly provided for a portion among a plurality of second electrodes.

Not several, but only one DC electrode may be arranged as well. Further, a plurality of DC electrodes may be individually controlled in voltage application in the same way as the divided electrodes in the seventh embodiment. Further, the DC electrode does not have to be provided at the position in the second direction (y-direction) where the velocity of the ion wind by the first electrode and second electrode is strong. For example, it may be provided at the position where the velocity of the ion wind by the first electrode and second electrode is weak so as to contribute to temporary uniformity of the distribution of ion wind by application of a DV voltage according to need, or may be provided with a width equivalent to the first electrode and second electrode to simply contribute to a rise of the velocity of the ion wind as a whole.

In a worked product, the direction of the plan view, the first direction and second direction when grasping the positional relationships of the first electrode and second electrode etc. may be suitably extracted. For example, in the case where the ion wind flows along the surface of the dielectric, the positional relationship of the first electrode and second electrode and so on may be grasped when viewing the surface thereof from a plane. Further, for example, the first direction and second direction may be suitably extracted from the positional relationship between the first electrode and the second electrode and the shape of the first electrode as a whole. Further, as understood from the explanation of the embodiments explained above, in the first electrode, the portion which is dominant with respect to the ion wind flowing from the first electrode side to the second electrode side is the downstream side edge, therefore the direction in which that downstream side edge extends may be extracted as the second direction as well. For example, in the case where the downstream side edge is an arc, the direction along the arc may be extracted as the second direction and the radius direction may be extracted as the first direction. Further, for example, in the case where the downstream side edge of the first electrode is bent several times, the first direction and second direction may be extracted for each portion of the downstream side edge of the first electrode.

Note that, from the description of the present application, it is possible to extract the invention of an ion wind generating device having a first electrode, a plurality of divided electrodes, a power supply which can induce ion wind by supplying voltage between the first electrode and the plurality of divided electrodes, and a switch part which can switch a connection state between the power supply and the plurality of divided electrodes. In the ion wind generating device, the distance between the downstream side edge of the divided electrode and the downstream side edge of the first electrode does not have to change.

Reference Signs List

1 . . . ion wind generating device, 3 . . . ion wind generator, 7 . . . dielectric, 9 . . . first electrode, 9*b* . . . downstream side edge, 11 . . . second electrode, 11*b* . . . downstream side edge, 11*m* . . . downstream area, and d . . . distance.

The invention claimed is:

1. An ion wind generator comprising:

a first electrode, a second electrode having a downstream area which is arranged at a position in a plan view shifted from the first electrode in a first direction, and a dielectric between the first electrode and the second electrode, wherein, in the plan view, a distance in the first direction from a downstream side edge of the first electrode to the downstream side edge of the downstream area differs in a second direction which is perpendicular to the first direction, a length in the first direction of the downstream area is different in the second direction, and the downstream area is formed so that its length in the first direction becomes large at the center in the second direction.

2. The ion wind generator as set forth in claim 1, wherein, across the downstream side edge of the first electrode or the upstream side edge of the second electrode, the downstream side part of the first electrode and the upstream side part of the second electrode overlap or are adjacent in the first direction or the distance between the two in the first direction is constant.

3. The ion wind generator as set forth in claim 1, wherein:

the first electrode includes an upstream area which is located on the side opposite to the first direction other than the second electrode, and a length in the first direction of the upstream area is larger at a position in the second direction where a length in the first direction of the downstream area is smaller.

4. The ion wind generator as set forth in claim 2, wherein:

the first electrode includes an upstream area which is located on the side opposite to the first direction other than the second electrode, and a length in the first direction of the upstream area is larger at a position in the second direction where a length in the first direction of the downstream area is smaller.

5. The ion wind generator as set forth in claim 1, wherein:

the dielectric has a first primary surface and a second primary surface at the back thereof, the second electrode is buried in the dielectric, the first electrode is provided at the first primary surface side other than the second electrode, the first electrode and the second electrode can induce ion wind along the first primary surface, a fourth electrode is buried in the dielectric at the second primary surface side other than the second electrode, a third electrode is provided at the second primary surface side other than the fourth electrode, the fourth electrode has a downstream area located on the side opposite to the first direction from the third electrode, and a length in the first direction of the downstream area of the fourth electrode is larger at a position in the second direction where a length in the first direction of the second electrode is smaller.

6. The ion wind generator as set forth in claim 2, wherein:

the dielectric has a first primary surface and a second primary surface at the back thereof, the second electrode is buried in the dielectric, the first electrode is provided at the first primary surface side other than the second electrode, the first electrode and the second electrode can induce ion wind along the first primary surface, a fourth electrode is buried in the dielectric at the second primary surface side other than the second electrode, a third electrode is provided at the second primary surface side other than the fourth electrode, the fourth electrode has a downstream area located on the side opposite to the first direction from the third electrode, and a length in the first direction of the downstream area of the fourth electrode is larger at a position in the second direction where a length in the first direction of the second electrode is smaller.

7. An ion wind generating device comprising:

a first electrode, a second electrode having a downstream area which is arranged at a position in a plan view shifted from the first electrode in a first direction, a dielectric between the first electrode and the second electrode, and a power supply which supplies voltage between the first electrode and the second electrode and can make these electrodes induce an ion wind flowing in the first direction, wherein, in the plan view, a distance in the first direction from a downstream side edge of the first electrode to the downstream side edge of the downstream area differs in a second direction which is perpendicular to the first direction, a length in the first direction of the downstream area is different in the second direction, and the downstream area is formed so that its length in the first direction becomes large at the center in the second direction.

8. The ion wind generating device as set forth in claim 7, wherein:

the second electrode is divided into a plurality of divided electrodes in the second direction, and a switch part for switching the connection state between the power supply and the plurality of divided electrodes is provided.

* * * * *